United States Patent [19]

Kogane

[11] Patent Number: 4,462,588

[45] Date of Patent: Jul. 31, 1984

[54] APPARATUS FOR REGULATING THE CUTTING PLANE OF A STRIP

[75] Inventor: Mikio Kogane, Kanagawa, Japan

[73] Assignee: Fuji Photo Film Co., Ltd., Kanagawa, Japan

[21] Appl. No.: 363,750

[22] Filed: Mar. 30, 1982

[30] Foreign Application Priority Data

Apr. 1, 1981 [JP] Japan ..... 56-47148[U]

[51] Int. Cl.[3] ..... B65H 7/02

[52] U.S. Cl. ..... 271/265; 198/345; 271/206; 271/277

[58] Field of Search ..... 271/265, 277, 204, 205, 271/206; 226/92, 91; 198/341, 345, 434; 83/367, 370, 372, 614

[56] References Cited

U.S. PATENT DOCUMENTS

| | | | |
|---|---|---|---|
| 2,926,908 | 3/1960 | Bobst | 271/277 |
| 3,731,570 | 5/1973 | Nelson | 83/370 |
| 4,269,409 | 5/1981 | Simonek | 271/265 |
| 4,330,191 | 5/1982 | Rawlings | 226/92 |

*Primary Examiner*—Douglas C. Butler
*Assistant Examiner*—John A. Carroll
*Attorney, Agent, or Firm*—Sughrue, Mion, Zinn, MacPeak & Seas

[57] ABSTRACT

A strip conveyor transports a strip by the edge thereof with a guide clip, the ends of which are coupled to chains of the conveyor. Sensors are arranged at a position where the clip becomes disengaged from the conveyor, and upon both ends of the clips reaching this position, a holding and transporting device engages the strip, and then conveys it for cutting along lines perpendicular to edges of the strip.

7 Claims, 2 Drawing Figures

APPARATUS FOR REGULATING THE CUTTING PLANE OF A STRIP

BACKGROUND OF THE INVENTION

This invention relates to an apparatus for regulating the cutting plane of a strip.

The strip may, for example, be a strip of photographic printing paper. When developing images printed on a strip of photographic printing paper, it is, for example, known to engage the leading edge with a rod-shaped guide clip, and connect both ends of the guide clip to chain conveyors or like means moving through a developing tank. When cutting the strip into individual image frames after development, it is necessary to ensure that it is cut along a plane which is perpendicular to the longitudinal edges thereof. Accordingly, it is necessary to hold the strip in a position where the guide clip lies at right angles to the direction of strip conveyance, before the strip can be fed forward and cut along its leading edge adjacent to the guide clip so that the guide clip may be removed from the strip.

SUMMARY OF THE INVENTION

According to this invention, these requirements are achieved by the provision of a pair of sensors at the guide clip disengaging positions of a pair of oppositely disposed chain conveyor means, and holding means for pressing a strip after the arrival of the end of the guide clip at the disengaging position has been detected by one of the sensors, while the arrival of the other end of the guide clip at the disengaging position is detected by the other sensor. The sensors are positioned in a line perpendicular to the direction of strip conveyance, and transmit a signal for pressing the strip to the holding means when both ends of the guide clip have reached the sensors. Therefore, the strip is maintained at right angles to the conveyance direction, fed forward by a feed roller, and cut.

BRIEF DESCRIPTION OF THE DRAWINGS

The apparatus of the invention for regulating the cutting plane of a strip will now be described by way of example with reference to the accompanying drawings, in which.

DETAILED DESCRIPTION OF THE PREFERRED EMBODIMENTS

Figure 1:
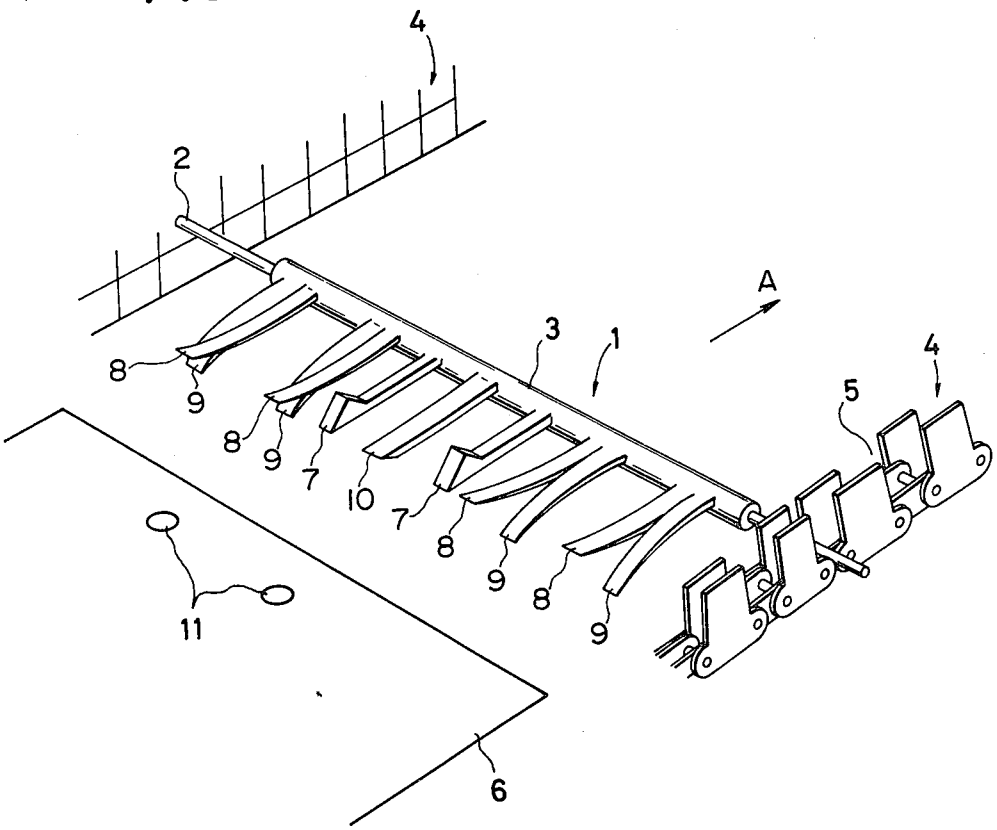
FIG. 1 is a perspective view of the guide clip and clains according to this invention.

A guide clip 1 comprises an integral combination of a rigid rod portion 2, and an engaging portion 3 formed from an elastic material such as a resin. The rod portion 2 can be engaged at both ends in grooves 5 of a pair of chains 4. The grooves 5 of one chain are aligned with those of the other chain relative to the conveyance direction indicated by the arrow A, so that the guide clip 1 may be disposed at right angles to the direction of conveyance. The grooves 5 of the chains 4 are detected by photoelectric sensors (not shown), and the clip 1 is engaged with the chains by a solenoid, or the like. The engaging portion 3 includes engaging pawls 7, upwardly curved projections 8, downwardly curved projections 9, and a central engaging projection 10 which extend in a direction opposite to the direction of conveyance A. A strip 6 has its leading edge received between the upwardly and downwardly curved projections 8 and 9, while the engaging pawls 7 are engaged with the perforations 11 formed adjacent to the leading edge of the strip, so that the guide clip 1 may be engaged with the strip 6.

For correctly engaging the guide clip 1 with the chains 4, it is also possible to provide a clutch for each chain 4, and detect any positional deviation of the ends of the clip relative to the direction of conveyance. If the ends of the rod portion 2 have been engaged in misaligned grooves 5 of the chains, resulting in a failure of the guide clip 1 to lie at right angles to the direction of conveyance A, the clutch for one of the chains may be actuated for disengaging it from its drive, whereby the guide clip 1 may then be positioned at right angles to the direction of conveyance A. The former method is, however, preferable to the latter, since the latter method necessitates a temporary interruption in conveyance.

Figure 2:
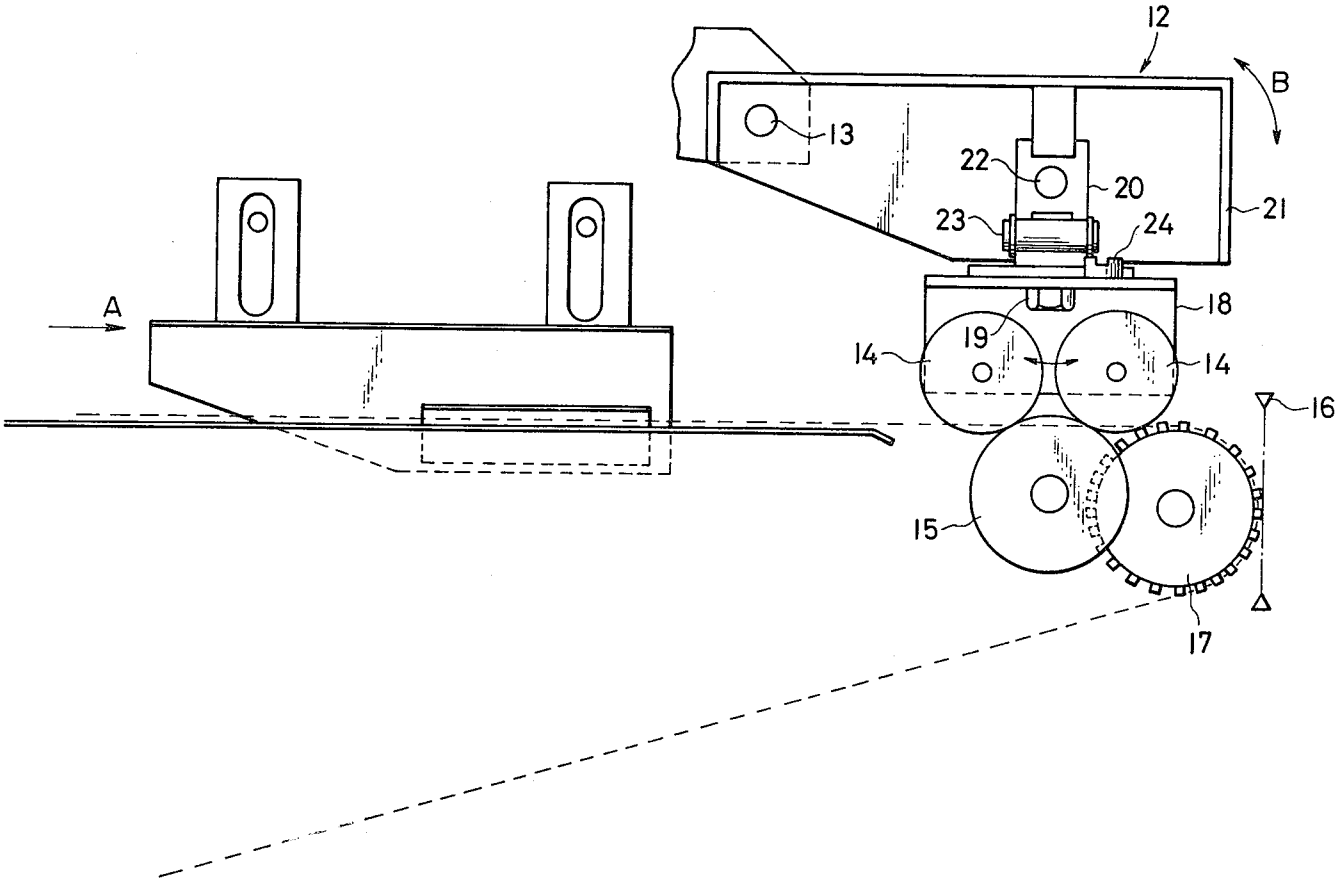
FIG. 2 is a schematic side elevation of the apparatus of the invention.

FIG. 2 is a schematic side elevational view of an apparatus embodying this invention. A strip holding device 12 is rotatably supported by a pin 13. If the guide clip passes a sensor provided on the upstream side of the apparatus (not shown), the holding device 12 is rotated upwardly about the pin 13 by a motor or like driving means (not shown), so that pacer rollers 14 and a strip feed roller 15 in the holding device 12 may define therebetween a space through which the guide clip 1 can pass. A pair of sensors 16 are each provided at a position where ends of the guide clip 1 are disengaged from the corresponding chain. The sensors 16 may, for example, be photoelectric sensors detecting both ends of the guide clip. The sensors 16 are connected with each other with an AND circuit. If the guide clip 1 has been erroneously positioned between misaligned chain grooves, one end of the clip 1 reaches the position of one of the sensors and is disenagaged from the chain, while the other end of the clip 1 does not yet reach the other sensor; therefore, the chains continue to be driven. When the other end of the clip 1 has reached the other sensor, the other sensor detects the end of the clip, and the AND circuit functions to lower the pacer rollers 14, whereby the strip is held between the pacer rollers 14 and the feed roller 15. The AND connection of the sensors 16 maintains the guide clip 1 at right angles to the direction of conveyance. The functions of the sensors 16 can advantageously satisfactorily compensate for any misalignment between opposite chain grooves that may arise from loosening of the chains 4, or from other causes.

The chains 4 are driven by sprockets 17 to convey the guide clip 1 connected to the strip 6. After the pacer rollers 14 have been lowered, the strip 6 is conveyed by the feed roller 15, and pushes the guide clip 1 forward. The pacer rollers 14 preferably exert a pressure of about 3 Kg on the strip. The strip 6 to be cut is held under pressure between the pacer rollers 14 and the feed roller 15 adjacent to its leading edge and lying at right angles to the direction of conveyance. The strip 6 is driven by the feed roller 15 in parallel to the conveyance direction, and can, therefore, be cut along a plane perpendicular to this direction.

The pacer rollers 14 are rotatably supported on a side plate 18 which is connected to a post 20 by a bolt 19. The post 20 is connected to a swing plate 21 which is rotatable about the pin 13 in the direction of the arrow B. The side plate 18 is rotatable about a pin 22 in the direction of the arrow illustrated below bolt 19 in FIG.

2, while it is also rotatable about a pin 23 to alter the inclination of the axes of the pacer rollers 14. An eccentric pin 24 is provided for rotating the axes of the rollers 14 in a horizontal plane. These arrangements ensure snug fitting of the pacer rollers 14 with the feed roller 15. Even if, as a result of an error in manufacture, or other causes, the feed roller 15 does not have its axes disposed in an optimum position, the adjustability of the axes of the pacer rollers 14 in the aforesaid three directions ensures that the pacer rollers 14 have uniform surface contact with the feed roller 15 along the entire length thereof. Accordingly, it is possible to prevent any meandering of the strip 6.

What is claimed is:

1. A strip conveying station, comprising; a pair of first conveying means, said first conveying means being respectively engageable with both ends of a guide clip engaging the leading edge of said strip, to convey said guide clip and said strip; and means for regulating a cutting plane of said strip comprising a pair of sensors provided at locations where said first conveying means are disengaged from said ends of said guide clip, holding means for applying pressure to said strip after said ends of said guide clip have been detected by said sensors, and second conveying means provided opposite to said holding means, for conveying said strip.

2. A device as claimed in claim 1, said holding means comprising a pair of rollers arranged confronting said second conveying means.

3. A device as claimed in claim 2, said second conveying means comprising a roller in contact with said strip, said holding means operating as idler rollers for said second conveying means.

4. A device as claimed in claim 2, said holding means being normally suspended above said second conveying means, and being movable to contact said second conveying means, through said strip, upon said detection.

5. A device as claimed in claim 4, said holding means rollers being suspended in a manner allowing for rotation in a plane containing axes of said rollers, as well as in planes perpendicular to said plane.

6. A device as claimed in claim 2, said second conveying means conveying said strip in a direction perpendicular to said leading edge, whereby said strip may be cut perpendicular to said leading edge.

7. A device as claimed in claim 1, said sensors being coupled in a manner such that said holding means is actuated to engage said strip upon both said ends of said guide clip being detected by said sensors.

* * * * *